US005757944A

United States Patent [19]

Jensen et al.

[11] Patent Number: 5,757,944

[45] Date of Patent: May 26, 1998

[54] HEADSET WITH ADJUSTABLE EARHOOK

[75] Inventors: Finn Jensen, Struer; Steve McGugan, Copenhagen, both of Denmark

[73] Assignee: GN Netcom A/S, Copenhagen, Denmark

[21] Appl. No.: 741,397

[22] Filed: Oct. 29, 1996

Related U.S. Application Data

[63] Continuation of Ser. No. 489,801, Jun. 13, 1995, abandoned.

[51] Int. Cl.[6] ..... H04R 25/00

[52] U.S. Cl. ..... 381/187; 381/183; 379/430

[58] Field of Search ..... 381/25, 68, 68.6, 381/68.7, 69, 72, 74, 183, 187, 205; 181/128, 129, 130, 135; 379/430, 433

[56] References Cited

U.S. PATENT DOCUMENTS

| | | | |
|---|---|---|---|
| 1,587,643 | 8/1926 | Harman . | |
| 2,474,135 | 6/1949 | White . | |
| 2,485,405 | 10/1949 | Olney et al. . | |
| 2,506,490 | 5/1950 | Coley . | |
| 2,513,746 | 7/1950 | Rohr . | |
| 2,586,644 | 2/1952 | Gilbert . | |
| 2,939,923 | 6/1960 | Henderson . | |
| 3,440,365 | 4/1969 | Bryant et al. . | |
| 3,682,268 | 8/1972 | Gorike . | |
| 3,862,378 | 1/1975 | Norris . | |
| 3,993,879 | 11/1976 | Larkin . | |
| 4,020,297 | 4/1977 | Brodie . | |
| 4,273,969 | 6/1981 | Foley et al. . | |
| 4,335,281 | 6/1982 | Scott et al. . | |
| 4,453,050 | 6/1984 | Enokido . | |
| 4,702,345 | 10/1987 | Janssen et al. . | |
| 4,720,857 | 1/1988 | Burris et al. . | |
| 4,763,753 | 8/1988 | Killion . | |
| 4,875,233 | 10/1989 | Derhaag et al. . | |
| 4,893,344 | 1/1990 | Trägardh et al. . | |
| 5,134,655 | 7/1992 | Jensen | 381/183 |
| 5,298,692 | 3/1994 | Ikeda et al. | 381/69 |
| 5,446,788 | 8/1995 | Lucey et al. | 379/430 |

FOREIGN PATENT DOCUMENTS

| | | |
|---|---|---|
| 436377 | 10/1926 | Austria . |
| 0 158 391 | 10/1985 | European Pat. Off. . |
| 60-10999 | 1/1985 | Japan . |
| 1377237 | 12/1974 | United Kingdom . |
| 2036505 | 6/1980 | United Kingdom . |
| WO 90/10361 | 9/1990 | WIPO . |

*Primary Examiner*—Huyen Le

*Attorney, Agent, or Firm*—Merchant, Gould, Smith, Edell, Welter & Schmidt

[57] ABSTRACT

A telephone headset apparatus is disclosed. This headset apparatus includes a body having a microphone at one end and a transducer at the opposite end, an earhook, for attaching the apparatus to the ear of the operator, and a mechanism, contained within the body in a movable engagement, for holding the earhook in a frictional engagement that allows for movement of the earhook, with three degrees of freedom. The mechanism is located at a point within the body where upon adjustment of the earhook by the operator (i.e., rotated, tilted, pivoted) the headset apparatus remains properly balanced and within the sound envelope of an operator, for uninterrupted operation.

9 Claims, 6 Drawing Sheets

HEADSET WITH ADJUSTABLE EARHOOK

This is a Continuation of application Ser. No. 08/489,801, filed Jun. 13, 1995, now abandoned.

FIELD OF THE INVENTION

This invention relates to telephone headsets, and in particular to a telephone headset that is held on the ear of an operator. This telephone headset is designed to remain properly balanced and positioned for proper functioning when the headset body and/or the earhook is moved for adjustment on the ear of the operator.

BACKGROUND OF THE INVENTION

Telephone headsets continue to become smaller and decrease in weight, as electronics become increasingly sophisticated. Several of these headsets include complex bulky structures for retaining the headset on the head of the operator such that the microphone remains in the sound envelope of the operator and the ear piece remains in the ear of the operator. Other headsets are designed to attach to the ear of an operator. However, these headsets exhibit a major drawback in that even slight adjustments will cause the headset to become unstable and unbalanced, whereby the microphone portion moves out of the sound envelope of the operator's voice and the transducer moves out of the ear of the operator.

SUMMARY OF THE INVENTION

The present invention improves on the prior art by providing a telephone headset apparatus that remains balanced on an operator, within the sound envelope and thus, properly functioning, when the headset apparatus is being adjusted on the head of the operator. The telephone headset apparatus comprises a body having a microphone at one end and a transducer at the opposite end, an earhook, for attaching the apparatus to the ear of the operator, and a mechanism contained within the body for holding the earhook in a frictional engagement that allows for rotation of the earhook. The mechanism is retained in the body such that it is movable, allowing for earhook movement having three degrees of freedom (i.e., rotating, tilting and pivoting). The mechanism is located at a point within the body where upon adjustment of the earhook by the operator, the headset apparatus remains properly balanced, for uninterrupted operation.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

Figure 1:
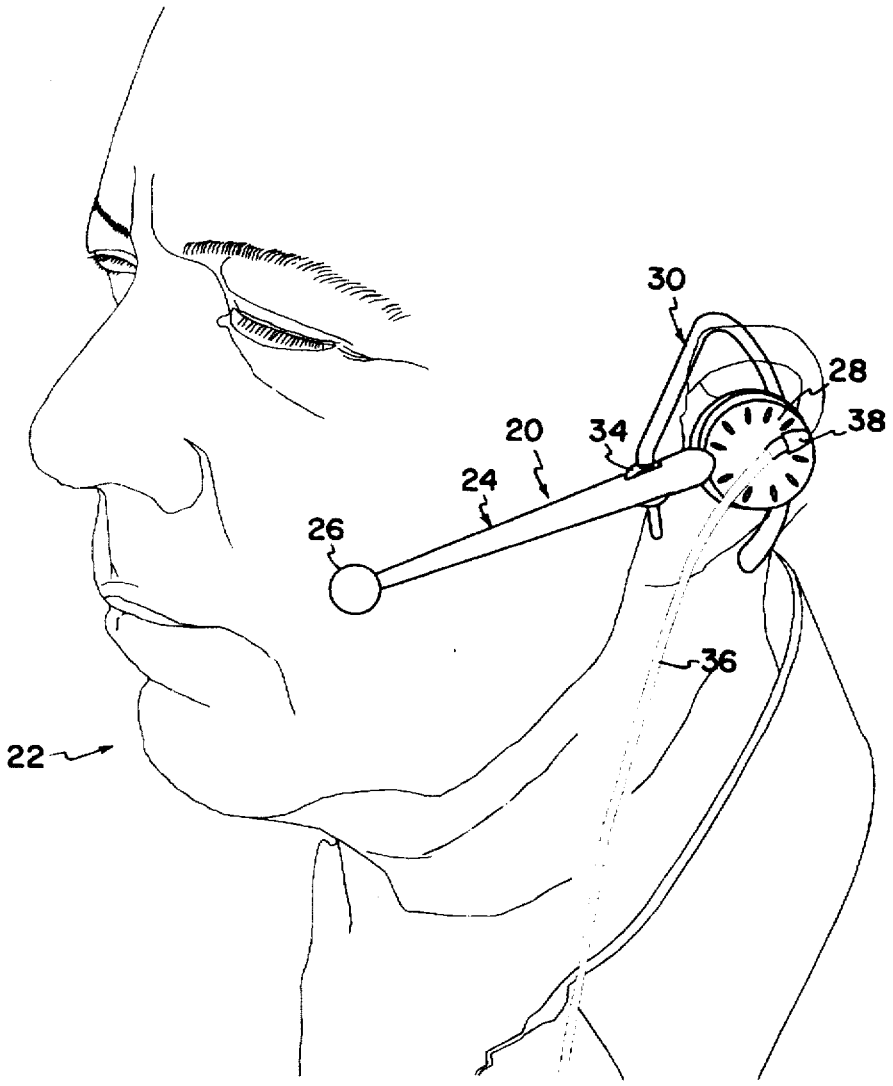
FIG. 1 is a perspective view of the apparatus of the present invention.
Figure 2:
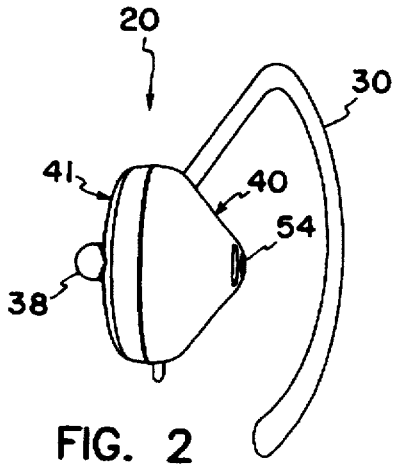
FIG. 2 is a rear view of the apparatus of the present invention.
Figure 3:
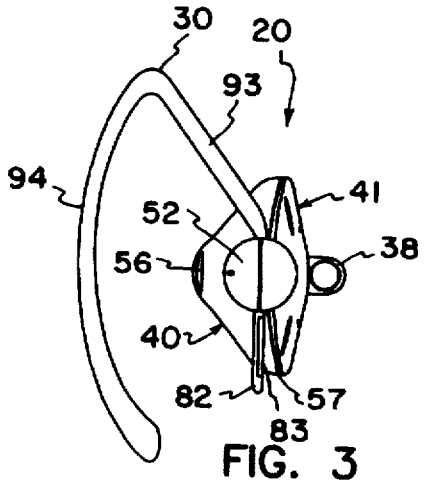
FIG. 3 is a front view of the apparatus of the present invention.
Figure 4:
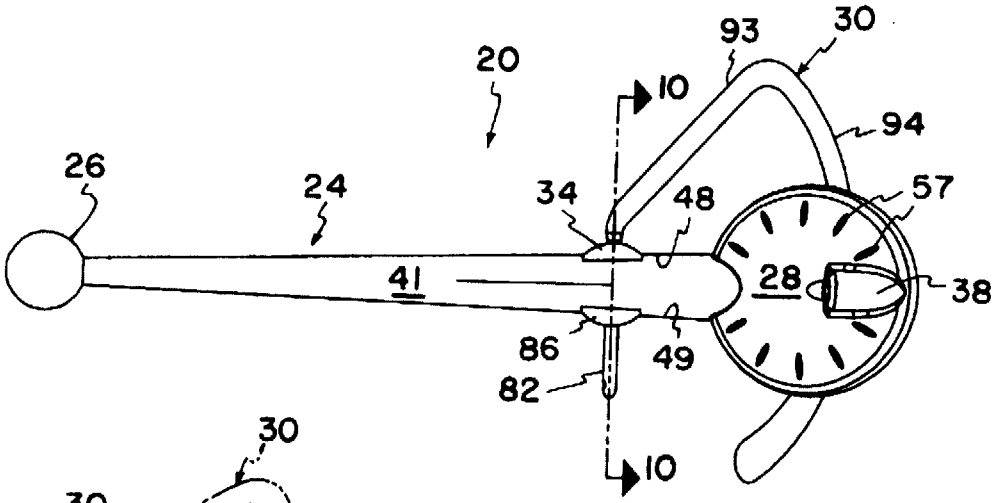
FIG. 4 is a side view of the apparatus of the present invention.

FIG. 1 shows the headset 20 of the present invention in use with a telephone operator 22. The headset 20 includes a body 24 having a microphone 26 at one end and a transducer 28 at the opposite end. The body 24 is held on the ear of the telephone operator 22 by an earhook 30, rotatably mounted in a clutch 34. The clutch 34 is movably retained in the body 24, and is positioned along the body 24 at a point intermediate the microphone 26 and the transducer 28. This arrangement of the earhook 30 within the clutch 34, coupled with the arrangement of the clutch 34 in the body 24, allows the earhook 30 movement with three degrees of freedom. A cord 36, received in a protrusion 38 of the transducer 28, allows connection of the headset 20 to a telephone system (not shown).

FIGS. 2–5 show the headset 20 in greater detail. The headset 20 includes a body 24 terminating in a microphone 26 and a transducer 28. The body 24 is preferably made of two pieces, an inner piece 40, placed adjacent the face of the operator 22 (FIG. 1), and an outer piece 41, located opposite the face of the operator 22 (FIG. 1). Each piece 40, 41 is preferably tapered such that the portion of the body 24 at the microphone end has a smaller circumference than at the transducer end.

The inner and outer pieces 40, 41 also include recessed portions 44, 45 on both their upper surfaces 48 and lower surface 49, that form a well 50, extending through the body 24. The well 50 frictionally retains the clutch 34 in a movable engagement. The well 50 is located at a point along the body 24, where the microphone 26 and the transducer 28 will remain stable and balanced on the operator 22 (FIG. 1), keeping the microphone 26 within the operator's voice envelope. The headset 20 remains functional and in proper operation, when the earhook 30 and/or the clutch 34 are moved as the headset 20 is being placed onto or adjusted to the ear of the operator 22 (FIG. 1).

The inner piece 40, in particular that portion that forms the microphone 26, includes an opening 52 for sound. The portion of the transducer 28 formed by this inner piece 40, is preferably asymmetrically conical in shape, for adaptation to the ear, and terminates in a vertex 54, surrounded by apertures 56, open to the ambient environment. The vertex 54, and the apertures 56 therein, are positioned off-center with respect to the generally circular shape of the inner piece 40 that forms a portion of the transducer 28. This off-center positioning allows the vertex 54 to fit inside the ear in close proximity to the ear canal, while enhancing the balance of the headset 20 on the operator 22 (FIG. 1).

The outer piece 41, in particular that portion that forms the transducer 28, includes radially aligned apertures 57, open to the ambient environment. The protrusion 38 extends from this outer piece 41 to receive the connecting cord 36 (FIG. 1).

Figure 6:
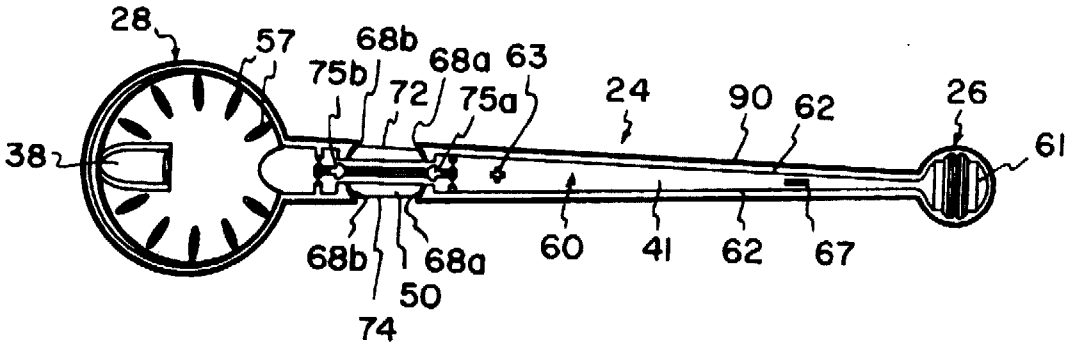
FIG. 6 is a sectional view of the apparatus of the present invention taken along line 6—6 of FIG. 5, with the clutch and earhook removed.
Figure 7:
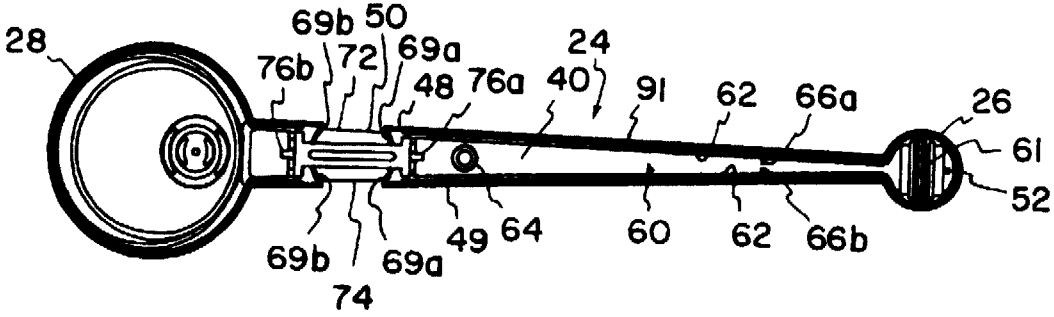
FIG. 7 is a sectional view of the apparatus of the present invention taken along line 7—7 of FIG. 5, with the clutch and earhook removed.

Turning additionally to FIGS. 6 and 7, the inner piece 40 and the outer piece 41 combine to form a hollow cavity 60 for housing for the various electronic (microelectronic) components, such a microphone unit (not shown), amplifiers (not shown), receivers (not shown), wires (not shown) and other components typically known to those of skill in the art for telephone or other headsets. The hollow cavity 60 at the microphone 26 includes indentations 61 conforming to the shape of the microphone component and guideribs 62 for wires. The cavity 60 includes the well 50, that contains the clutch 34.

The structural integrity of the cavity 60 is maintained by an outwardly extending support member 63, on the outer piece 41 that is received in a cup 64 protruding from the inner piece 40. Additionally, the inner piece 40 includes teeth 66*a*, 66*b* that receive a perpendicular rib 67 on the outer piece 41 in a cooperating arrangement for further maintaining the structural integrity of the cavity 60. Additional support structures for maintaining the structural integrity of the cavity 60, other than those described, but well know to those skilled in the art are also permissible, provided they allow for proper placement of the electronic components and wires placed in the cavity 60.

The well 50 is designed to contain the clutch 34 in a movable engagement. The well 50 includes oppositely disposed concave walls 68*a*, 68*b*, 69*a*, 69*b* on the inner piece 40 and the outer piece 41 respectively, having curvatures approximately equal to that of the clutch 34. The concave walls 68*a*, 68*b*, 69*a*, 69 extend from near the center of each piece 40, 41 to openings 72, 74 (formed by the recessed portions 44, 45 of the inner and outer pieces 40, 41) at the upper 48 and lower 49 surfaces of the body 24. These openings 72, 74 have lengths less than the diameter of the clutch 34. Convex-ended members 75*a*, 75*b*, oppositely disposed on the outer piece 41, are positioned to abut the ends of the clutch 34, preferably at the opposite peripheral ends. This abutment is such that the clutch 34, and ultimately the earhook 30, can be pivoted laterally about the body 24 for adjusting the earhook 30. This is described in detail in FIGS. 10 and 11 below.

The convex-ended members 75*a*, 75*b* are received by cut outs 76*a*, 76*b* extending from the inner piece 40. The cooperating structures of the convex-ended members 75*a*, 75*b* and the cut outs 76*a*, 76*b* also function to maintain the structural integrity of the cavity 60. Alternately, additional convex ended members and cut outs may be employed and any or all of the convex ended members and cut outs could be located on either the inner piece 40 and the outer piece 41.

Figure 11:
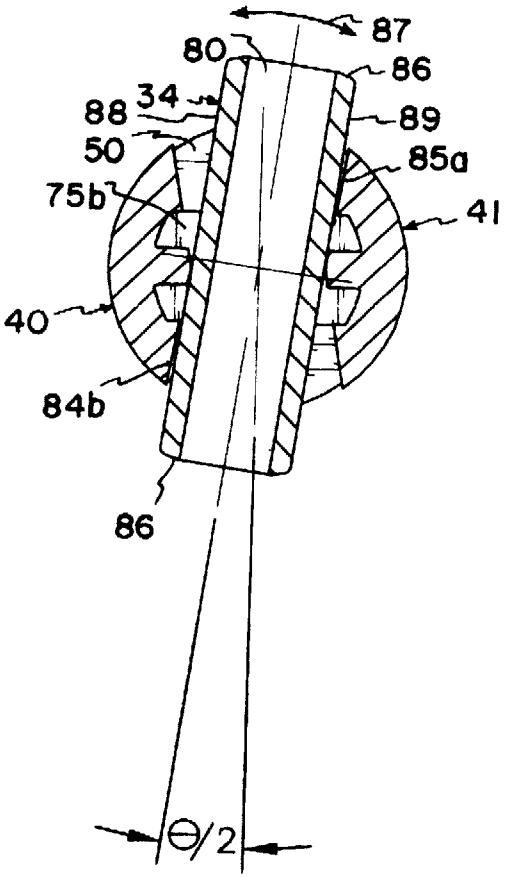
FIG. 11 is a sectional view in accordance with FIG. 10, with the clutch having been moved.
Figure 10:
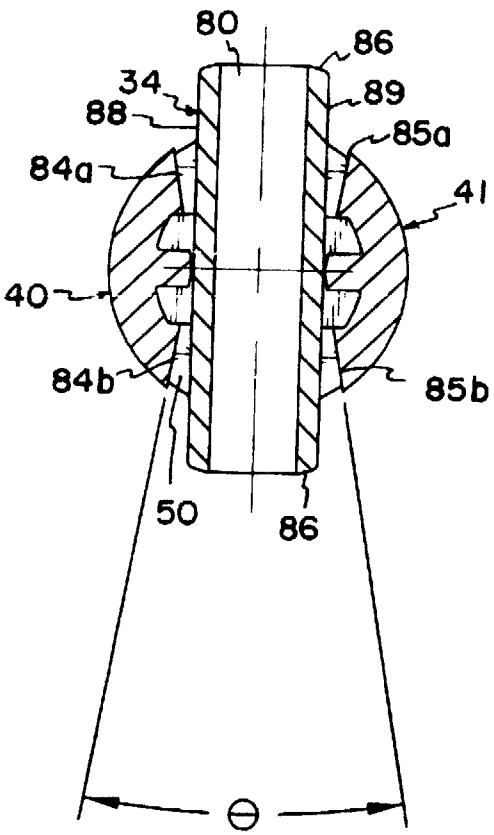
FIG. 10 is a sectional view of the apparatus of the present invention taken along line 10—10 of FIG. 4, with the earhook removed.

Referring additionally to FIGS. 10 and 11, the clutch 34 is preferably a lightweight plastic or polymeric disc. A bore 80 extends through clutch 34 and receives a first linear portion 82 of the earhook 30. The inner and outer pieces 40, 41 include walls 84*a*, 84*b*, 85*a*, 85*b* extending from a central point and tapered outwardly toward the upper 48 and lower 49 surfaces. The tapers combined form an dihedral angle 8, of approximately 20°, with a single taper being angled at θ/2 (with respect to the vertical). The clutch peripheral edge surface 86 abuts the convex-ended members 75*a*, 75*b*, allowing the clutch 34 to be moved (pivoted), in the direction of the double arrow 87, to positions as far as where the clutch side faces 88, 89 abut opposite tapered walls 84*b*, 85*a* (shown in FIG. 11).

The inner piece 40 and the outer piece 41 that form the body 24, are preferably made of lightweight plastics by injection molding or the like. Alternately, other similar materials known to those skilled in the art, made by conventional techniques, could be used as well. These lightweight materials decrease the stress of the headset 20 on the ear. The inner piece 40 and the outer piece 41 are preferably attached by a friction or snap fit, by having cooperating (i.e. male-female) edges 90, 91 (FIGS. 6 and 7) and secured by adhesives, spot welding or the like.

The earhook 30 is configured to the shape of the human ear, for retention thereon. The preferred earhook 30 includes a first linear portion 82, a second linear portion 93, and a curved portion 94. The first linear portion 82 is tapered to include a portion of a greater outside diameter than that of the bore 80 (FIGS. 10 and 11), in order to be received in the bore 80 with sufficient friction to retain the earhook 30, and allow for the earhook 30 to rotate therein (as detailed in FIG. 8 below). This first linear portion 82 may also include a cut out segment 83 (FIG. 3) to facilitate movement through the bore 80. Other alternate designs are permissible, provided they are configured for the human ear. This earhook 30 is preferably made of lightweight plastic or metal. It may be coated with an elastomer or other similar material to provide increased friction, enhancing the retention forces between the first linear portion 82 and the bore 80 (FIGS. 10 and 11) of the clutch 34. The earhook 30 may also be padded with additional soft material if desired, for the operator's comfort.

Figure 8:
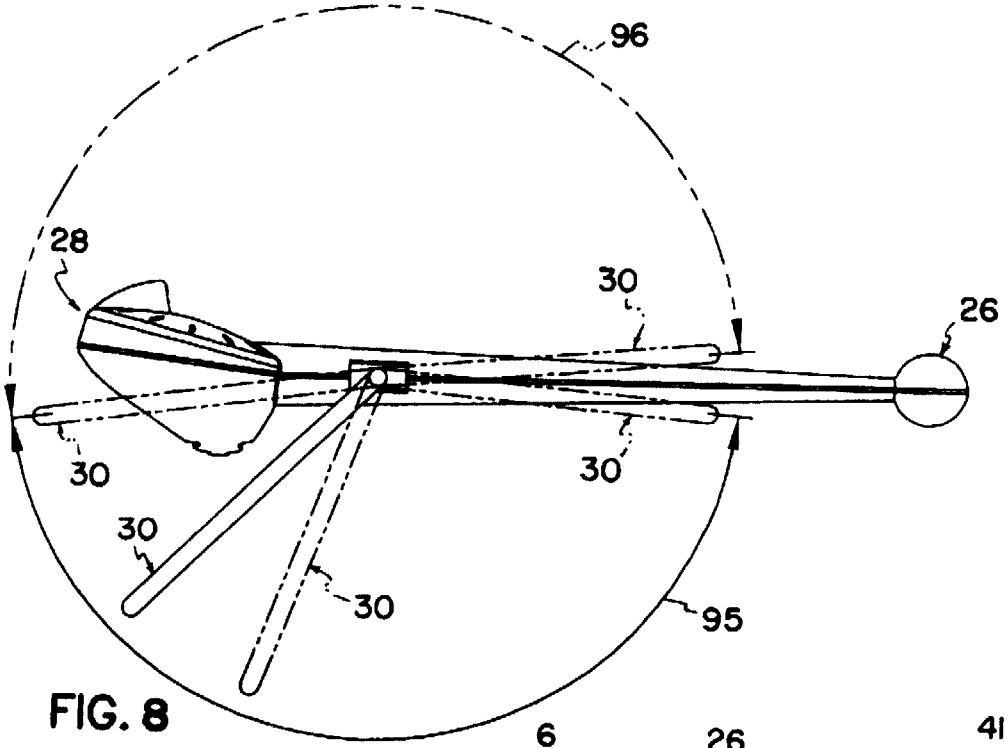
FIG. 8 is a top view of the apparatus of the present invention detailing movement of the earhook.

FIG. 8 details movement of the earhook 30 within the clutch 34. This functional retention of the earhook 30 in the bore 80 (FIGS. 10 and 11) allows the earhook 30 to rotate about the bore 80 to the positions for ordinary usage on the ear or storage, detailed in phantom lines and solid line 95. Also shown is the rotational capability of earhook 30, as detailed in phantom lines and broken line 96.

Figure 9:
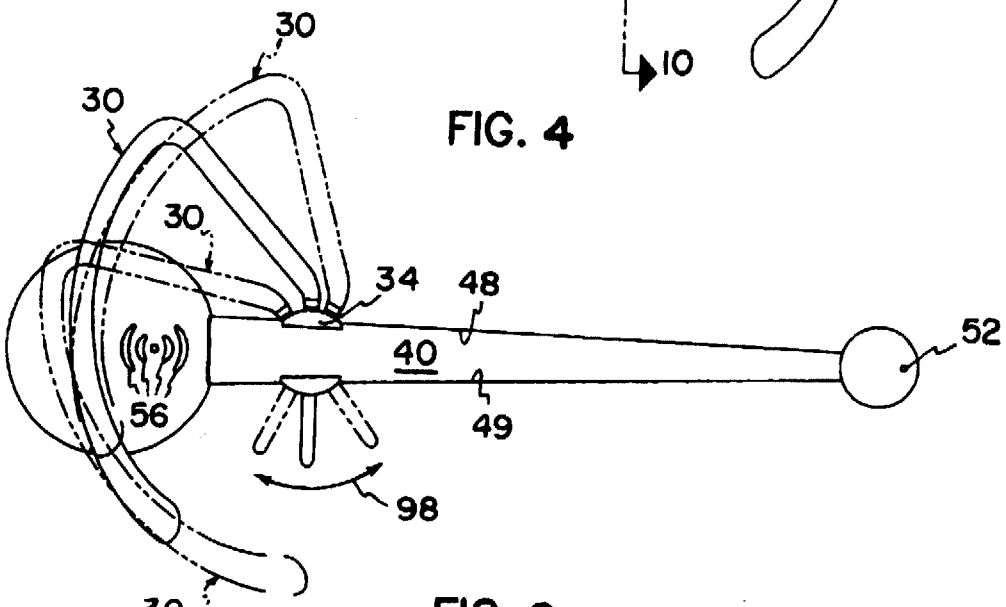
FIG. 9 is a side view of the apparatus of the present invention detailing movement of the earhook.
Figure 5:
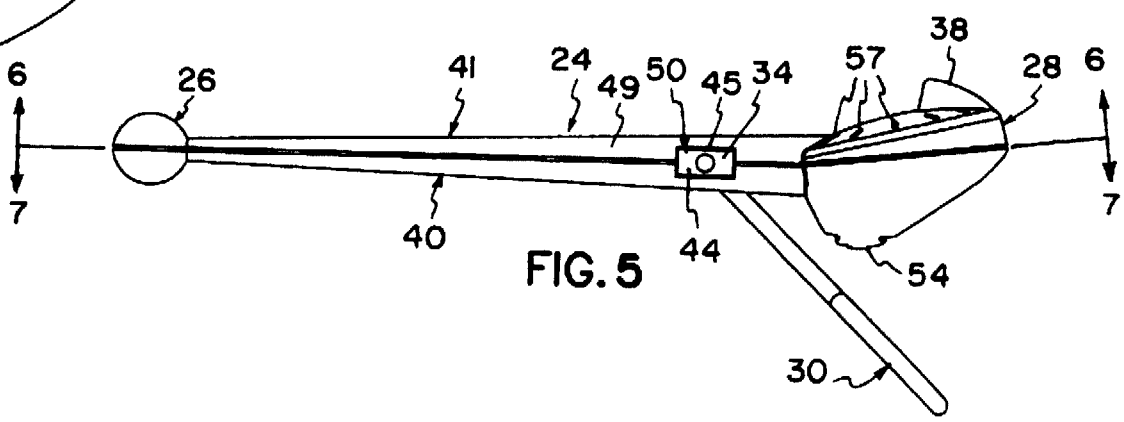
FIG. 5 is a bottom view of the apparatus of the present invention.

FIG. 9 details rotation of the clutch 34 within the well 50 of the body 24. The rotation of the clutch 34 (in the direction of the double arrow 98) allows the earhook 30 to move (tilt) to the positions, shown in phantom lines for adjustment on the ear of the operator 22 (FIG. 1).

While the invention has been described in connection with an embodiment, it will be understood that the invention is not limited to that embodiment. The invention is intended to cover all alternatives, modifications and equivalents as may be included within the spirit and scope thereof, as defined by the appended claims.

What is claimed is:

1. A telephone headset comprising:

a body having oppositely disposed first and second ends;

a longitudinal axis extending along the body from the first end to the second end;

a microphone being connected to the body at the first end, and a transducer being connected to the body at the second end;

an earhook, having an end portion and a body portion, the end portion transversely extending through the body at a balance point intermediate the microphone and transducer, and the body portion being configured to be held on an operator's ear; and means for holding the earhook, disposed at least in part within the body proximate the balance point to allow the earhook to have three degrees of freedom of movement with respect to the balance point, such that upon adjustment of the earhook, the body remains properly balanced and within a sound envelop of the operator's ear.

2. The telephone headset of claim 1, additionally including means for connecting the headset to a telephone system.

3. The telephone headset of claim 1, wherein the earhook holding means includes a circular clutch having a throughgoing bore for receiving and retaining the earhook.

4. The telephone headset of claim 1, wherein the body includes two cooperating pieces, each of the cooperating pieces including a recessed portion, the recessed portions defining a well for movably retaining the earhook holding means.

5. The telephone headset of claim 1, wherein the transducer includes a vertex for positioning within the ear of the operator proximate to the ear canal.

6. The telephone headset of claim 5, wherein the transducer is substantially circular and has a center point, and terminates in a point different from the center point.

7. A telephone headset comprising:

a body having oppositely disposed first and second ends and a longitudinal axis extending from the first end to the second end;

a microphone being connected to the body at the first end, and a transducer being connected to the body at the second end;

a well, being disposed at least in part within the body proximate a balance point intermediate the microphone and transducer, an earhook, having an end portion and a body portion, the end portion transversely extending through the well at the balance point; and a clutch, the clutch receiving the earhook, the clutch movably retained at least in part within the well for movement in at least two degrees of freedom with respect to the body proximate the balance point to allow the earhook to have three degrees of freedom of movement with respect to the balance point, such that upon adjustment of the earhook, the body remains properly balanced and within a sound envelop of an operator.

8. The telephone headset of claim 7, wherein the transducer includes a vertex for positioning within the ear of the operator proximate to the ear canal.

9. The telephone headset of claim 8, wherein the transducer is substantially circular and has a center point, and terminates in a point different from the center point.

* * * * *